United States Patent [19]

Webster et al.

[11] Patent Number: 4,878,589

[45] Date of Patent: Nov. 7, 1989

[54] LINERLESS CAP CLOSURE

[75] Inventors: Charles Webster, Oak Lawn; Christian J. John, Downers Grove, both of Ill.

[73] Assignee: American National Can Company, Chicago, Ill.

[21] Appl. No.: 186,460

[22] Filed: Apr. 26, 1988

Related U.S. Application Data

[63] Continuation-in-part of Ser. No. 43,106, Apr. 27, 1987, Pat. No. 4,741,447.

[51] Int. Cl.[4] ..... B65D 41/34; B65D 53/00

[52] U.S. Cl. ..... 215/252; 215/344; 215/DIG. 1

[58] Field of Search ..... 215/344, DIG. 1, 252, 215/345, 329

[56] References Cited

U.S. PATENT DOCUMENTS

| | | | |
|---|---|---|---|
| 2,952,374 | 9/1960 | Pryale | 215/345 X |
| 4,429,802 | 2/1984 | Marks | 215/DIG. 1 |
| 4,489,845 | 12/1984 | Aichinger et al. | 215/344 X |
| 4,526,282 | 7/1985 | Dutt et al. | 215/252 |
| 4,530,436 | 7/1985 | Wiedmer | 215/252 X |
| 4,564,112 | 1/1986 | Brever | 215/252 X |
| 4,598,835 | 7/1986 | Brownbill | 215/DIG. 1 |
| 4,664,279 | 5/1987 | Obrist et al. | 215/252 |
| 4,667,838 | 5/1987 | Yeager | 215/252 |

*Primary Examiner*—Donald F. Norton

*Attorney, Agent, or Firm*—Wallenstein Wagner & Hattis, Ltd.

[57] ABSTRACT

A linerless cap closure includes a circular top wall and a depending annular skirt having an internal thread with a tamper-evident band below the skirt. A sealing member is integral with the lower surface of the top wall and includes an annular protrusion having a depending annular axial projection. The tamper-evident band is connected to the skirt with a plurality of spaced tear tangs and a permanent connection and the band has an inwardly-directed bead with inclined ramps extending from the inner edge of the bead to the lower edge of the bead.

6 Claims, 1 Drawing Sheet

FIG. 1
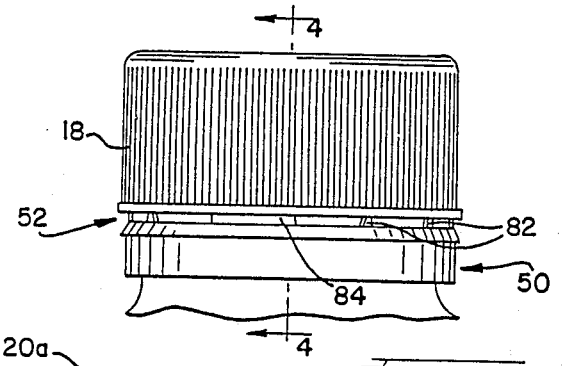
FIG. 3
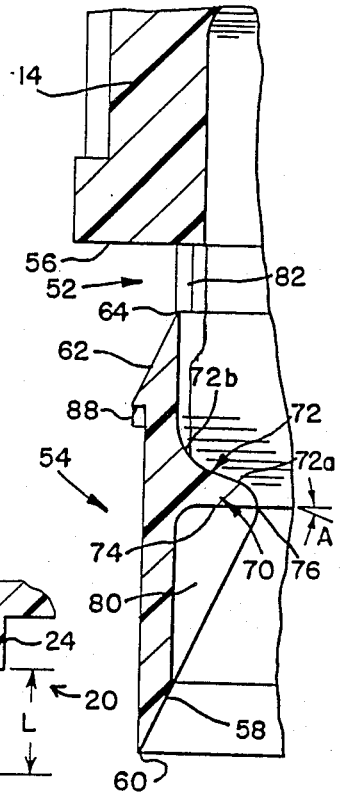
FIG. 5
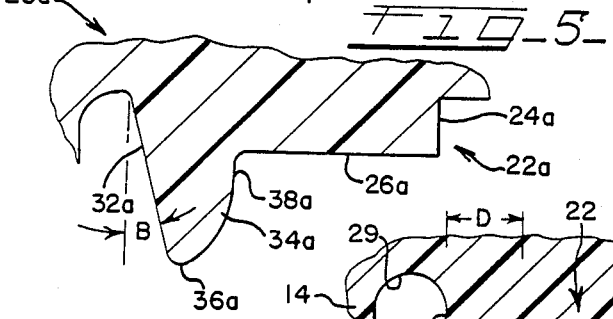
FIG. 2
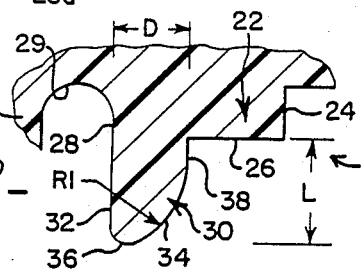
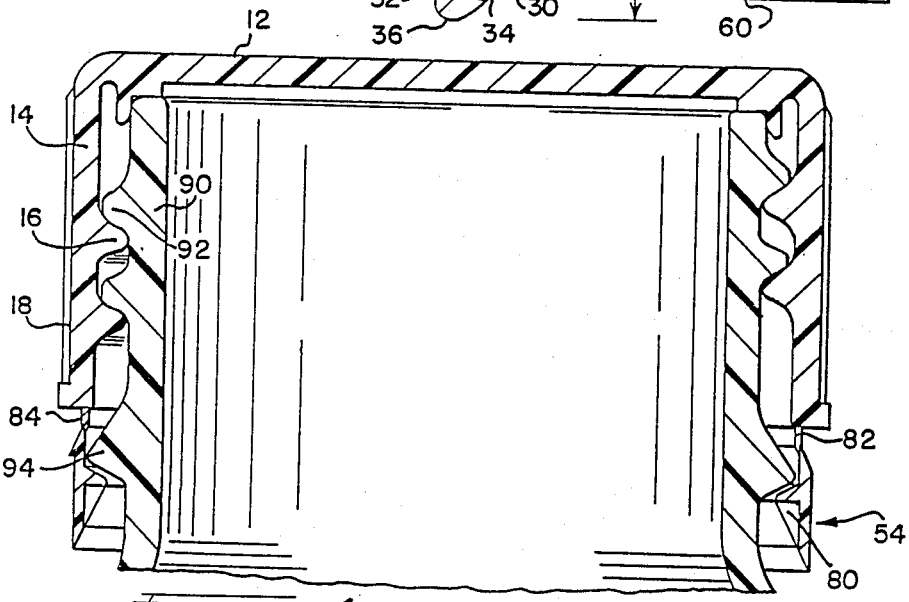
FIG. 4

LINERLESS CAP CLOSURE

REFERENCE TO RELATED APPLICATION

This application is a continuation-in-part of U.S. Ser. No. 42,106, filed Apr. 27, 1987 now U.S. Pat. No. 4,741,447 for a "Linerless Cap Closure".

TECHNICAL FIELD

The present invention relates generally to tamper-evident closures of plastic material for sealing containers of various types, such as plastic bottles.

BACKGROUND PRIOR ART

Both plastic and metal closures for various bottles and containers which include a tamper-evident feature have been known for many years. In most cases, the tamper-evident feature comprises a lower shoulder or skirt portion which is intended to be separated or fractured from the remainder of the closure upon removal of the closure from the container so that it becomes evident that the container has been opened. In the past, the majority of such types of closures have been predominantly made of metal; however, the use of metal has resulted in significant problems, which relate primarily to the fact that removal of the closure does not result in a clean and efficient fracture of the lower skirt portion. Also, in some instances, sharp edges are created that cause danger to the user.

In connection with plastic closures of this type, again, a large number have been patented in the past. Exemplary of one type of closure is shown in U.S. Pat. No. 4,033,472. The closure in this patent requires a two-step application procedure which includes the initial application of the closure to the bottle, followed by a heating process whereby the lower depending bead is deformed against the surface of the bead or collar on the bottle itself.

When the cap closure is formed of a plastic material, the liner normally applied to the inner surface of the closure is generally eliminated and a sealing means is formed integral with the bottom surface of the circular top wall. Many of the linerless closures available commercially rely upon deflection of a flexible fin depending from the top wall of the closure. The lateral flexing movement of the fin tip is designed to cause the tip of the fin to move into sealing engagement with an edge of the container finish. However, this created problems in that the sealing portion of the closure will lose its elastic memory after storage for a period of time and then tends to reduce the sealing force. Thus, the seal may be lost.

SUMMARY OF THE INVENTION

According to the present invention, linerless cap closures have been developed having a sealing means which can be easily molded and which also include a tamper-evident feature. More specifically, the linerless cap closure consists of a generally circular top wall with a depending annular skirt or side wall having an internal thread adapted to engage with an external thread on a container neck and sealing means depending from the lower surface of the top wall adjacent the annular skirt.

The sealing means includes a first annular rib integral with the lower surface and being generally rectangular in crosssection and an annular projection integral with the rib adjacent the outer wall with the projection having an outer wall defining an extension of the outer wall of the rib and an arcuate inner wall merging with the outer wall through a reduced radiused portion, so that upon threading of the closure onto a container neck, the inner wall of the projection will engage and slide along the outer edge of the container neck to provide a seal and the bottom wall of the rib will engage a top surface of the container neck to aid in the sealing of the container.

In one embodiment, the outer wall of the rib and the outer wall of the projection define a surface that extends substantially parallel to the axis of the closure, while in an alternate embodiment, this surface defines a small acute angle opening to the center of the closure at its open end.

According to one aspect of the invention, the linerless cap closure also has a tamper-evident band which extends below the annular skirt and is connected thereto by a frangible connection. The band has a main body that has an inwardly-directed bead intermediate upper and lower edges with the bead defining an upwardly-directed shoulder adapted to engage an underside of a rib on the container neck. The band also has ramp means extending between an inner edge of the bead and a lower edge of the main body for guiding the bead over the rib on the container neck while the closure is threaded onto the container.

There is also provided a permanent connection between the annular skirt and the band so that the band will be removed with the closure.

BRIEF DESCRIPTION OF DRAWINGS

FIG. 1 is a side elevational view of the container constructed in accordance with the teachings of the present invention;

FIG. 2 is an enlarged fragmentary cross-sectional view of the sealing means;

FIG. 3 is an enlarged crosssectional view of the tamper-evident band;

FIG. 4 is a cross-sectional view, as viewed along line 4—4 of FIG. 1, showing the closure on a container neck; and, FIG. 5 is a cross-sectional view similar to FIG. 2 showing a slightly-modified sealing means.

DETAILED DESCRIPTION

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

FIG. 4 shows a cap closure, generally designated by reference numeral 10, that is particularly adapted as a closure for a plastic bottle that has a clearly-defined neck finish thereon. The closure 10 consists of a generally circular top wall 12 with a depending annular skirt or side wall has an integral thread 16 formed thereon, while the outer wall is serrated at 18 to provide a gripping surface.

According to one aspect of the invention, the lower surface of the top wall 12 has an annular sealing means 20 formed integral therewith and located adjacent the side wall 14. The sealing means is illustrated in detail in FIG. 2 and consists of a generally rectangular annular rib or protrusion 22 that has an inner wall 24, a bottom wall 26 and an outer wall 28. The outer wall 28 merges with the inner surface of the side wall 14 through an arcuate radiused annular portion 29.

The sealing means also includes an annular projection 30 that is integral with the bottom wall 26 and has an outer wall or surface 32 that defines an integral extension of outer wall 28 of rib 22. The projection 30 also has an arcuate inner wall 34 which merges with the outer wall 32 through a small radiused portion 36 at the lower end or tip of the projection 30. The inner wall 34 has a flattened portion 38 which extends substantially parallel to the axis of the closure and extends substantially perpendicular to the bottom wall 26 of rib 22. The projection 30 has a cross-sectional thickness which approaches the length of the projection so as to minimize the amount of deflection that the projection will experience while the closure is threaded onto the container neck.

Thus, the projection has a thickness D between planar portion 38 and outer wall 32 which has a dimension that is equal to approximately 0.030 inch, while the length of the projection L is about 0.040 inch. The arcuate inner wall has a radius R1 which is less than the length of the projection and is preferably on the order of about 0.034 inch and the radius of the rounded end 36 is about 0.005 inch. The radial dimension between the inner and outer walls 24 and 28 of the rib is more than twice the dimension D so as to provide sufficient rigidity for the projection 30 to prevent any significant deflection of the projection 30 while the closure is being threaded onto the container neck. Also, the annular diameter of the planar inner wall portion 38 is approximately equal to the minimum diameter of the external surface of the container neck so that extended surface contact is maintained between the planar portion 38 and the exterior surface of the container neck when the closure is fully threaded onto the container neck, even if the neck finish has a minimum diameter.

If the container neck has an external diameter that is slightly larger, the outer edge of the neck will engage the arcuate portion 34 and will slide along the arcuate portion until the protrusion engages the top surface of the neck. Thus, the arcuate portion 34 and the linear portion 38 of the projection 30 will be deformed somewhat to conform to the peripheral surface of the container neck and provide extended surface contact with the exterior of the neck.

More importantly, the annular projection 30 will actuation expand and closely conform to the outer surface of the neck and provide a first seal while the second seal is made between surface 26 and the top surface of the neck.

According to a further aspect of the invention, the closure 10 also includes a tamper-evident band 50 that is located below the lower end of the skirt portion 14 and is integrally joined thereto by a frangible connection 52. The tamper-evident band 50 consists of a generally annular main body 54 that has an upper edge and a lower edge. The upper edge is connected to the lower edge 56 of the side wall 14 through the frangible connection 52. The main body 54 has a lower tapered edge 58 which tapers to a point 60 while the upper edge 62 is likewise tapered to a point 64. The outer surface of the main body 54 has a horizontal shoulder 88 that is utilized in removing the closure and band from the mold and prevent severing of the frangible connection.

The elongated body 54 has an inwardly-directed bead 70 that defines an upwardly-directed arcuate shoulder 72 and a lower flat horizontal 74. The inner edge 76 of the annular bead is rounded off and ramp means 80 extend between the inner edge 76 and the tapered portion 58 of the lower edge of the main body. The arcuate shoulder 72 has a lower inclined portion 72a that defines an angle A with respect to a horizontal plane and an arcuate surface 72b which merges with the inner wall of the band. The angle A is preferably on the order of about 25°, while the radius of arcuate surface 72b is about 0.023 inch.

The ramp means is in the form of a plurality of circumferentially-spaced triangular supports, the inner surface of which defines an extension of the inclined lower end portion 58 and merges at its upper end with the rounded portion 76. Thus, the triangular supports or ramp means 80 are utilized to guide the inwardly-directed bead 70 over a rib defined on the container neck, as will be described later.

It has been found that the number of ramps 80 and the thickness of the band 54 are important in successful application of the closure to the container. Thus, there are preferably six ramps 80 spaced 60°.

Also, the inner diameter of the bead is dimensioned such that there is an interference fit with the underside of the rib 94 on the neck and the surface **72*a* of the bead. The parts are dimensioned such that the band 54 will be inclined by an inverted angle of about 10° with respect to the surface of the neck. This will create additional friction between the band the neck finish when the closure is removed to insure that the tangs 82** are severed.

The frangible means 52 consists of a plurality of circumferentially-spaced tear tangs 82 that have a thickness which is significantly smaller than the thickness of the side wall 14 and is also smaller in cross-section that the thickness of the main body 54. The tangs 82 have an inner wall that s coincident with the inner wall of the closure side wall 14. The tang extends downwardly along the inner wall of the main body 54 to provide reinforcement and prevent the main body 54 from rolling under the skirt 14 during application of the closure to a bottle. In the illustrated embodiment, there are approximately 10 circumferentially-spaced connecting members 82, and one permanent connecting member 84 has a larger circumferential dimension than the remaining connecting members, for a purpose that will described later.

The configuration of the tamper-evident band, particularly the inwardly-directed bead, aids in removing the closure from the mold without destruction of the tangs in an efficient manner. Thus, the main body has shoulder 88 formed thereon that is spaced about the bead 70. It should be noted that a rectangular abutment is located between the shoulder 88 and the tapered wall 62 to provide additional strength during removal of the closure from the mold. In removing the closure from the mold, a mold element engages the shoulder 88 and the lower surface 56 of the skirt to maintain the integrity of the tear tangs. Since the shoulder is located well above the bead 70, the inclined arcuate surfaces **72*a* and 72*b*** will ride on the associated mold surface and the main body will be expanded to clear the mold surface. It should be noted that the wall thickness of the main body is about 0.015 inch and the bead has a radial dimension of about 0.035 inch, the main body will readily deflect to accommodate removal of the band from the mold.

In assembling the closure 10 onto the container neck 90 having an internal thread 92, the inclined surfaces or ramps 80 will slide along the external thread 92 of the container neck and will then engage rib 94 on the container neck 90 and the band 50 will have sufficient resiliency to expand and slide over the rib formed on the container neck. The upwardly-directed shoulder 72 will then engage the underside of the rib 94. At the same time, the thread 16 will engage the cooperating thread on the external surface of the container neck and the inner arcuate surface of the projection will engage the outer edge of the upper surface of the plastic container neck.

The projection has sufficient rigidity to prevent any significant deflection and, if the diameter of the neck is slightly larger than the minimum diameter, the inner surface will be deformed to conform to the outer peripheral surface of the container neck. As the closure is further threaded onto the container neck, the bottom wall of the rib 22 will engage the upper flat surface of the container neck and will thereby provide additional sealing capability between the closure and the neck.

After the closure is on the container, removal torque applied to the closure will produce frictional forces between the neck rib 94 and the bead 70 to sever the small frangible connecting members 82. However, the larger connecting member 84 will have sufficient strength to overcome the frictional forces and will keep the band connected to the closure and be removed with it. This feature is important in packaging certain products. For example, if the product is oil, a band retained on the container could dislodge while the oil is being poured into an engine, which would ruin the engine.

A slightly modified form of sealing means **20*a* is illustrated in FIG. 5 and includes a rib 22*a* that is integral with the lower surface of the top wall of the closure. Rib 22*a* has an inner flat wall 24a and a bottom flat wall 26*a* that defines a sealing surface. The width of the flat wall or band 26*a*** is preferably substantially a minimum of one-half the thickness of the top edge of the neck finish.

The sealing means **20*a* also has a sealing projection 30*a* which is similar to projection 30 and has an inner flat portion 38*a* which merges with a lower rounded tip 36*a* through an arcuate portion 34*a*. In this embodiment, the outer wall 32*a* is flat and defines a small acute angle B with respect to the axis of the closure and opens toward the open end of the closure. The angle A is preferably between 10° and 25° and, more specifically, about 15°. This construction provides more rigidity in the area of the sealing wall or surface 38*a***.

Of course, the dimensions can readily be varied without departing from the spirit of the invention.

While the specific embodiments have been illustrated and described, numerous modifications come to mind without significantly departing from the spirit of the invention and the scope of protection is only limited by the scope of the accompanying claims.

I claim:

1. A linerless cap closure comprising a generally circular top wall with a depending annular skirt having an internal thread adapted to engage with an external thread on a container neck and sealing means depending from a lower surface of said top wall adjacent said annular skirt, said sealing means including an annular protrusion integral with said lower surface and being generally rectangular in cross-section and having an outer wall, an inner wall and a bottom wall, and an annular projection integral with said bottom wall of said protrusion, said projection having a flat outer wall and an arcuate inner wall merging with said flat outer wall through a reduced radiused portion, said inner wall of said projection merging with said bottom wall of said protrusion intermediate opposite ends thereof and having a flat wall portion extending perpendicular to said bottom wall so that upon threading of said closure onto a threaded container neck the projection will engage and slide along an outer edge of the container neck and provide a side seal with said flat wall portion and said bottom wall of said protrusion will engage on a top surface of said container neck to produce an additional seal.

2. A linerless cap closure as defined in claim 1, further including a tamper-evident band extending below said annular skirt and connected thereto by a frangible connection, said band including a main body having an inwardly-directed bead intermediate upper and lower edges, said bead defining an upwardly-directed shoulder adapted to engage an underside of a rib on the container neck, and ramp means extending between an inner edge of said bead and a lower edge of said main body for guiding said bead over said rib on said container neck while the closure is threaded onto the container neck.

3. A linerless cap closure as defined in claim 2, further including a permanent connection between said band and said annular skirt so that said band is removed with said closure after said frangible connection is broken.

4. A linerless cap closure as defined in claim 1, in which said outer wall of said projection extends substantially parallel to the axis of said closure.

5. A linerless cap closure as defined in claim 1, in which said outer wall of said projection defines a small acute angle with the axis of said closure and opens to the center of the open end of said closure.

6. A linerless cap closure comprising a generally circular top wall with a depending annular skirt having an internal thread adapted to engage with an external thread on a container neck and sealing means depending from a lower surface of said top wall adjacent said annular skirt, said sealing means including an annular protrusion integral with said lower surface and being generally rectangular in cross-section and having an outer wall, an inner wall and a flat bottom wall, and an annular projection integral with said bottom wall of said protrusion, said projection having an outer flat wall and an arcuate inner wall merging with said outer wall through a reduced radiused portion, said inner wall of said projection merging with said flat bottom wall of said protrusion intermediate said inner and outer walls of said protrusion and extending substantially perpendicular to said bottom wall at a point of intersection so that upon threading of said closure onto a threaded container neck, the projection will engage and slide along an outer edge of the container neck to provide a side seal and said flat bottom wall of said protrusion will engage on a top surface of said container neck to produce an additional top seal.

* * * * *